United States Patent [19]

Hepworth et al.

[11] 4,234,393

[45] Nov. 18, 1980

[54] MEMBRANE PROCESS FOR SEPARATING CONTAMINANT ANIONS FROM AQUEOUS SOLUTIONS OF VALUABLE METAL ANIONS

[75] Inventors: Malcolm T. Hepworth, Golden; John M. Laferty, Wheatridge, both of Colo.

[73] Assignee: Amax Inc., Greenwich, Conn.

[21] Appl. No.: 31,325

[22] Filed: Apr. 18, 1979

[51] Int. Cl.[3] ..... C25C 1/22

[52] U.S. Cl. ..... 204/1.5; 204/86; 204/96; 204/105 R

[58] Field of Search ..... 204/1.5, 86, 96, 105 R

[56] References Cited

U.S. PATENT DOCUMENTS

| | | | |
|---|---|---|---|
| 2,636,852 | 4/1953 | Juda et al. | 204/151 |
| 2,723,229 | 11/1955 | Bodamer | 204/98 |
| 2,739,934 | 3/1956 | Kunin | 204/96 |
| 2,780,514 | 2/1957 | Lutz | 423/7 |
| 3,276,991 | 10/1966 | Haai | 204/296 |
| 3,553,126 | 1/1971 | Oberhofer | 210/37 |
| 3,764,503 | 10/1973 | Lancy et al. | 204/180 P |
| 3,936,362 | 2/1976 | Vanderpool et al. | 204/86 |
| 3,947,332 | 3/1976 | Vanderpool et al. | 204/86 |
| 4,073,709 | 2/1978 | Pittie et al. | 204/113 |

FOREIGN PATENT DOCUMENTS

| | | |
|---|---|---|
| 224683 | 8/1959 | Australia . |
| 1353977 | 5/1974 | United Kingdom . |

*Primary Examiner*—Leland A. Sebastian

*Attorney, Agent, or Firm*—Michael A. Ciomek; Donald T. Black

[57] ABSTRACT

An aqueous solution of at least one valuable oxyanion containing molybdenum, tungsten, vanadium, or uranium is refined to lower the content of contaminant anions such as $PO_4^{-3}$, $SO_4^{-2}$, $NO_3^-$, $Cl^-$, $ClO_3^-$, and $ClO_4^-$, by subjecting the solution to electrolysis at a pH of from 0.5 to 4.0 between a cation-permselective membrane and an anion-permselective membrane having tertiary amine or quaternary ammonium anion exchange groups, to cause contaminant anions to pass from the solution into the anolyte. Ammonium molybdates, tungstates, vanadates, and uranates are formed from the thus-refined solution by subjecting it to a second stage of electrolysis at a pH of at least 7 between a cation-permselective membrane and an anion-permselective membrane to cause valuable oxyanions to pass from the solution into an anolyte which comprises an aqueous solution of ammonia and to form the desired ammonium compound.

28 Claims, 1 Drawing Figure

MEMBRANE PROCESS FOR SEPARATING CONTAMINANT ANIONS FROM AQUEOUS SOLUTIONS OF VALUABLE METAL ANIONS

BACKGROUND OF THE INVENTION

Field of the Invention

This invention relates generally to the recovery of valuable metal anions, specifically oxyanions containing molybdenum, tungsten, vanadium, or uranium, from aqueous solutions such as leach liquors containing such oxyanions and also containing contaminant anions such as $PO_4^{-3}$, $SO_4^{-2}$, $NO_3^-$, $Cl^-$, $ClO_3^-$, and $ClO_4^-$. More specifically, the invention is an electrolytic process using ion-permeable membranes to facilitate the recovery of valuable metal oxyanions, and of compounds formed from such oxyanions, in purer form by lowering the contaminant anion content and cation content of aqueous solutions containing the valuable metal oxyanions and the contaminant anions. Furthermore, the invention permits recovery of the contaminant anions in usable form.

Valuable metals such as molybdenum, tungsten, vanadium, and uranium, are often recovered through processes which include caustic leaching of concentrates, to produce streams containing the desired metal as a valuable metal anion. The leaching operation also dissolves contaminant anions, such as $PO_4^{-3}$, $SO_4^{-2}$, $NO_3^-$, $Cl^-$, $ClO_3^-$ and/or $ClO_4^-$. For instance, in one process the tungsten-containing ore wolframite is digested with caustic to form a solution of sodium tungstate which contains other dissolved ions such as phosphate. Scheelite (calcium tungstate) is known to be treated by digestion with soda ash (or sodium carbonate), also to form a sodium tungstate solution contaminated with e.g. phosphate ion. In addition, acid leaching of tungsten ores will produce a tungstate product contaminated with the anion of the acid used, such as chloride anion.

The anions carried along with the valuable metal oxyanions are considered contaminants because they can reduce the concentration of the valuable metal anion and because they can cause the formation of useless by-products when the leach solution is subsequently treated to recover the desired metal. In addition, the contaminant anions can pose operational problems by limiting or interfering with the processes used to separate the valuable metal anions from the leach liquors. Many conventional separatory techniques produce waste streams of contaminant anions, which must somehow be disposed of. It is also desirable to increase the ratio of valuable metal oxyanions to cations in the solution, so as to facilitate subsequent recovery of the desired metal values.

Thus, it is desirable to separate the contaminant anions from the valuable metal anions in leach liquors, and preferably to do so while recovering the cations and contaminant anions in the form of useful byproducts, without introducing additional chemical species into the system.

The present discovery for achieving this objective lies in the field of electrolysis, which is concerned with processes in which ion-permeable permselective membranes are interposed between the anode and cathode of an electrolytic cell to control the passage of dissolved ions toward the electrodes.

Briefly, a permselective membrane may be described as a three-dimensional network of an insoluble organic polymer. Bound into the chains of the network are water insoluble reactive chemical groups which are free to dissociate and are capable of exchanging only cations or only anions, in roughly the same manner as granular ion exchange resins. The interstices between the chains are filled with water and are of such a size that ions can pass through only by displacing ions already on the reactive groups lining the passages. Since this displacement occurs by an ion exchange mechanism, and since the reactive groups of a given membrane will exchange only ions of a given sign, the membrane will readily pass ions of that given sign while resisting the passage of ions of the opposite sign. The membranes are formed so as to be substantially water impermeable, that is, they do not permmit water to pass in significant quantities. Permselective membranes thus possess many characteristics of granular ion exchange resins; however, since the principal mechanism by which the membranes operate is ion transfer through the membrane, the membranes do not require separate chemical regeneration or stripping steps for recovery of the desired molecular species as do granular exchange resins. Instead, continuous elution occurs on the electrode side of the membrane and continuous loading occurs on the feed side of the membrane. This feature means that processes utilizing permselective membranes are suitable for continuous operation.

Surprisingly, it has been discovered that under certain conditions an anion-permselective membrane will favor passage of the contaminant anions from a contaminated solution which also contains valuable metal oxyanions, following which the valuable metal oxyanions can be passed through the same or another anion-permeable membrane to permit their recovery, for instance as ammonium compounds, in the anolyte.

Description of the Prior Art

While anion-permselective membranes have been used previously to treat aqueous solutions containing metal ions, the prior art does not suggest the process of the present invention for reducing the contaminant anion content of an aqueous solution containing valuable metal oxyanions.

U.S. Pat. No. 2,723,229 discloses a 3-cell electrolytic system in which the feed cell is separated from the anode by an anionic permselective membrane and from the cathode by a cationic permselective membrane. This patent discloses that when a salt solution containing cations of a non-amphoteric metal (specifically, sodium) and cations of an amphoteric metal (specifically, zinc or aluminum) is placed in the feed cell and an electrical potential is applied, only the non-amphoteric sodium cations cross the cationic permselective membrane into the cathode cell. The only anions disclosed in the feed cell are sulfate ions, which freely migrate to the anode cell. There is no disclosure in this patent of the treatment of solutions which as fed contain valuable metal anions, nor of particular operating conditions in which freely migrating anions such as sulfate can be separated from valuable metal anions in the feed cell.

Other prior art processes have been disclosed that employ electrolytic cells using two permselective membranes, but these processes also fail to suggest conditions under which separation may be achieved between anions in the feed solution.

In U.S. Pat. No. 2,739,934 there is a disclosure of a three-cell electrolytic process for treating uraniumbearing sulfuric acid leach liquors containing metal ion impurities. The three cells are separated from each other by two anion-permselective membranes. The anode cell collects a product solution containing a uranyl sulfate complex, but sulfate ions also move freely from the feed solution into the product solution. There is no disclosure of any subsequent electrolytic process by which the uranium values and the sulfate ions in the anode cell are separated from each other. Three-cell electrolytic systems containing one cation- and one anion—permselective membrane are also disclosed in U.S. Pat. No. 3,764,503, to separate metal cations from sulfuric acid pickling bath liquors, in U.S. Pat. No. 4,073,709, to recover nickel and zinc from chloride solutions containing cations of nickel and zinc, and in U.S. Pat. No. 2,636,852 to electrodialyze salt water. None of these patents discloses how to separate contaminant from valuable metal anions.

In U.S. Pat. Nos. 3,936,362 and 3,947,332, Vanderpool et al. disclose processes employing a single ion-permeable membrane for treating aqueous solutions to recover, respectively, tungstates of ammonium, and heteropoly tungstate or molybdate acids. However, the disclosed processes fail to achieve any separation of the valuable tungstate or molybdate anions from contaminant anions such as sulfates or chlorides, which are thus free to contaminate the final products of the disclosed processes. There is no recognition in either of these patents of any process conditions under which the contaminant anion content of the solutions under treatment can be reduced.

As has been pointed out, the invention embodies not only operating conditions under which an anion-permselective membrane will selectively permit passage across it of contaminant anions from a solution containing valuable metal oxyanions, but also conditions under which the valuable metal oxyanions will cross the same or another anion-permselective membrane from a contaminant anion-depleted solution so that the valuable metal oxyanions can be recovered in the anolyte. This feature distinguishes the present invention from separatory techniques which work by permanently inhibiting selected ions from passing across a membrane, such as Australian Pat. No. 224,683, in which uranium ions are adsorbed on an ion exchange material contained in a polymeric sheet, or such as U.S. Pat. No. 3,276,991, in which a conventional anion-permselective membrane undergoes permanent chemical alteration of its surface so as to become permeable to monovalent but not polyvalent anions.

In addition, for the reasons discussed above, the present invention is quite distinct from processes disclosed in the prior art using beds of particulate ion exchange resin to remove anions of molybdenum (U.S. Pat. No. 3,553,126), uranium (U.S. Pat. No. 2,780,514), and vanadium (British Specification No. 1,353,977), from aqueous solutions containing those anions.

SUMMARY OF THE INVENTION

Stated generally, the invention comprises an electrolytic process for refining a pregnant solution containing alkali metal cations, at least one oxyanion of a valuable metal selected from the group consisting of molybdenum, tungsten, vanadium, and uranium, and at least one contaminant anion selected from the group consisting of $PO_4^{-3}$, $SO_4^{-2}$, $NO_3^-$, $Cl^-$, $ClO_3^-$, and $ClO_4^-$, comprising the steps of (a) providing an electrolytic cell having an anode compartment equipped with an insoluble anode, a cathode compartment equipped with an insoluble cathode, and a feed compartment separating the anode compartment from the cathode compartment, said anode compartment being separated from said feed compartment by an anion-permselective membrane and said cathode compartment being separated from said feed compartment by a cation-permselective membrane;

(b) establishing an aqueous solution in the anode compartment so that the anode is immersed therein;

(c) establishing an aqueous solution in the cathode compartment so that the cathode is immersed therein;

(d) feeding to the feed compartment pregnant solution having a contaminant anion concentration of at least about 50 grams per liter and a valuable metal oxyanion content of between about 25 and about 200 grams per liter;

(e) adjusting the pH of said pregnant solution in the feed compartment to a value between about 0.5 and about 4; and (f) impressing an electric potential of at least about 20 volts between the anode and cathode until the contaminant anion concentration in the pregnant solution is lowered by at least about 25 grams per liter, whereby contaminant anions from the pregnant solution migrate preferentially to the anode compartment to generate a strong acid solution, and alkali metal cations migrate to the cathode compartment to generate a strong caustic solution.

The invention further comprises an electrolytic process for refining a pregnant solution within the definition given above, and forming from the thus-refined solution at least one ammonium compound selected from the group consisting of ammonium molybdates, ammonium tungstates, ammonium vanadates, and ammonium uranates, comprising (a) treating the pregnant solution in accordance with the process described in steps (a) through (f) above whereby an intermediate solution is produced;

(b) providing an electrolytic cell having an anode compartment equipped with an insoluble anode, a cathode compartment equipped with an insoluble cathode and a feed compartment separating the anode compartment from the cathode compartment, said anode compartment being separated from said feed compartment by an anion-permselective membrane and said cathode compartment being separated from said feed compartment by a cation-permselective membrane;

(c) establishing an aqueous solution of ammonia in the anode compartment so that the anode is immersed therein;

(d) establishing an aqueous solution in the cathode compartment so that the cathode is immersed therein;

(e) feeding intermediate solution to the feed compartment;

(f) adjusting the pH of the intermediate solution in the feed compartment to at least about 7; and (g) impressing an electric potential of at least about 20 volts between the anode and cathode whereby oxyanions migrate into the anode compartment and form the desired ammonium compound, and alkali metal cations migrate to the cathode compartment to generate a strong caustic solution.

The strong acid which is formed in the anolyte during the electrolysis of the feed solution may be drawn off and used to adjust the pH of additional quantities of feed solution to between 0.5 and 4. Also, a strong alkali hydroxide solution is formed in the catholytes during electrolysis of the feed and intermediate solutions; the hydroxide may be recycled to adjust the pH of the solutions to be electrolyzed, and may also be used as lixiviant in caustic leaching operations.

DETAILED DESCRIPTION OF THE INVENTION

Figure 1:
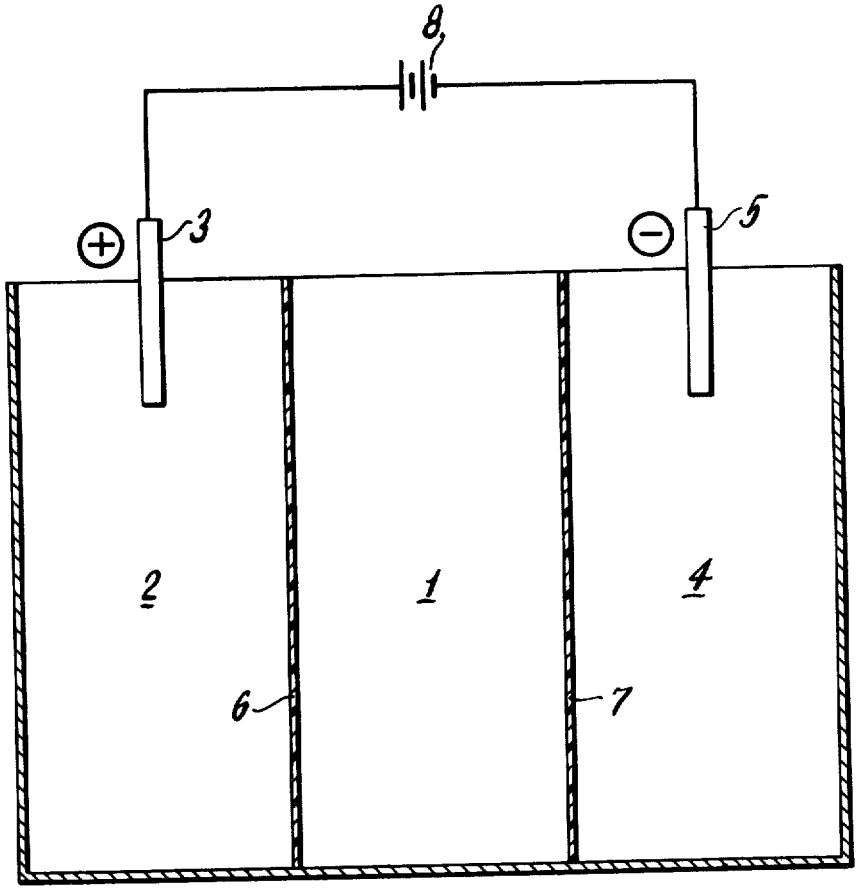
FIG. 1 is a cross-sectional view of a three-compartment electrolytic cell with which our invention may be practiced.

As indicated, the present invention may be carried out for refining aqueous solutions containing valuable metal oxyanions together with contaminant anions. The term "refining" will be understood to mean treating the solution to preferentially reduce the content therein of contaminant anions as opposed to valuable metal oxyanions, i.e. to reduce the ratio of contaminant anions to valuable metal oxyanions. In general, a "valuable metal oxyanion" is an oxyanion containing an atom of molybdenum, tungsten, vanadium, or uranium. Examples of such oxyanions are molybdates such as $MoO_4^{-2}$ and $Mo_2O_7^{-2}$; tungstates, such as $WO_4^{-2}$ and $W_2O_7^{-2}$; polytungstates, $WO_x^{-n}$ in which x is 2 to 3.5 and n is 2 to 10; vanadates, such as metavanadate, $VO_3^{-1}$, orthovanadate, $VO_3^{-3}$, pyrovanadate, $V_2O_7^{-4}$ and $V_5O_{16}^{-3}$; and uranates or uranides, such as $U_2O_7^{-2}$. In general, the valuable metal oxyanions may be any oxyanions of a desired metal which are produced in the leaching of concentrates containing the valuable metal.

The contaminant anions which are separated from valuable metal oxyanions in accordance with our invention are such anions as $PO_4^{-3}$, $SO_4^{-2}$, $Cl^-$, $NO_3^-$, $ClO_4^-$, and $ClO_3^-$, including generally any other contaminant anions found in leach liquors which are produced in leaching operations performed in the recovery of the valuable metals referred to above.

The valuable metal oxyanions and the contaminant anions are usually present as solutions of salts, often alkali metal salts, and thus the aqueous solutions which may be treated in accordance with our invention will often include alkali cations, such as sodium ion. Other cations may also be present, such as lithium, potassium, rubidium or cesium.

The valuable metal oxyanions in the solutions to be treated by the invention may be present in concentrations of anywhere between 25 and 200 grams per liter (gpl), and frequently in the range of 50 to 150 gpl. In a preferred embodiment of the invention, the valuable metal oxyanions are present in the range of 50 to 100 gpl in the aqueous feed solution.

Solutions having contaminant anion concentrations of at least 50 gpl (total contaminant concentration) can be refined conveniently in accordance with our invention, and contaminant anion concentrations ranging from 100 up to 250 gpl or above are frequently encountered and may be processed according to the invention. As can be seen, the ratio of valuable metal oxyanions to contaminant anions in the feed solution may range anywhere from 1:10 to 4:1.

Electrolysis of the feed solution is carried out with a cation-permselective membrane and an anion-permselective membrane, each of which is conventional and well-known to one skilled in this art. The anion-permselective membrane should be of the type having tertiary amine or quaternary ammonium anion exchange groups, made up of symmetrical, straight chain saturated amines. Suitable membranes may be made of thin (0.5 to 1.0 mm thick) sheets of organic polymers, such as vinyl, polyethylene or acrylonitrile, usually cross-linked with copolymers of vinyl monomers.

Satisfactory anion-permselective membranes are sold under the trade name "AR 103" made by Ionics, Inc., Watertown, Massachusetts. This type of membrane comprises a cross-linked polymer of e.g. vinyl monomers and contains quaternary ammonium anion exchange groups. The membranes are homogeneous films, cast in sheet form on reinforcing synthetic fabrics.

The cation-permselective membrane may have any of several types of cation exchange groups, such as sulfonate groups, in a polymeric sheet of e.g. vinyl chloride copolymerized with acrylonitrile, cross-linked with copolymers of vinyl monomers. Suitable cation-permselective membranes are sold under the trade name "61 AZL 183" by Ionics.

With reference to FIG. 1, the process of our invention is carried out in a three-compartment electrolytic cell having a feed compartment 1, an anode compartment 2 equipped with an insoluble anode 3, and a cathode compartment 4 equipped with an insoluble cathode 5. The feed compartment 1 is separated by an anion-permselective membrane 6 from the anode compartment 2, and by a cation-permselective membrane 7 from the cathode compartment 4. Feed solution is fed into the feed compartment 1, aqueous anolyte is fed into the anode compartment 2, and aqueous catholyte is fed into the cathode compartment 4, in any sequence desired. The anolyte should have a pH from 1.5 to 10.0, and more preferably from 8 to 10. An aqueous solution of $(NH_4)_2SO_4$ forms an acceptable anolyte for this electrolysis step. The catholyte should have a pH from 11 to 14, and more preferably from 12 to 14. An aqueous solution of NaOH forms an acceptable catholyte for this step. The feed solution should have a pH of from 0.5 to 4 prior to the start of electrolysis. The pH may be adjusted by adding as necessary a quantity of base, such as ammonia, or of acid, such as sulfuric acid, to the feed solution before or while the feed solution is contacted with the cation-permselective and anion-permselective membranes 6 and 7. Likewise, for that matter, adjustment of the pH of the catholyte and anolyte may also be made either before or after the respective solutions are contacted with the respective ion-permeable membranes. The pH range of 0.5 to 4 is satisfactory for all combinations of valuable metal oxyanions that may be contained in a feed solution treated according to our invention. Preferably, a pH of about 2.5 to about 3.5 should be maintained in the feed solution.

After the anion-permselective membrane 6 has been contacted with feed solution and the anolyte, and the cation-permselective membrane 7 has been contacted with the same feed solution and with the catholyte, an electrical potential is applied between the anolyte and catholyte, across the membranes and the feed solution, in order to stimulate the movement of ions across the two membranes. The electrical potential may be applied in the conventional manner, i.e. by immersing the anode 3 into the anolyte and the cathode 5 into the catholyte and connecting both electrodes to a voltage source 8. Both electrodes are insoluble in their respective electrolytes. The anode may be made of tantalum and the cathode may be made of Type 316 stainless steel. The magnitude of the applied voltage may be anywhere from at least about 10 volts up to about 50 volts, and completely satisfactory operation may be obtained by applying a voltage of about 10 to about 30 volts.

The movement of ions across the ion-permselective membranes begins practically immediately upon the application of the electrical potential, and continues as long as potential is applied until the contaminant anion content of the feed solution has been lowered to the desired degree. The contaminant anion content of the feed solution can be reduced by at least about 25 gpl without unduly reducing the valuable metal oxyanion concentration in the feed solution. Preferably, the contaminant anion concentration of the feed solution is reduced by at least about 75 gpl, and more preferably by about 100 gpl or more. A pregnant solution can also be subjected to successive stages of electrolysis under these conditions, as discussed below, to reach a final contaminant anion content of less than about 15 gpl, or down to about 5 gpl or less. Specific examples are given below from which one may determine the approximate amount of time necessary to lower the contaminant anion concentration of a feed solution to acceptable levels; however, to illustrate generally, 4 liters of feed solution containing total contaminant anion concentration of 106 gpl can be refined to 15 gpl of contaminants in 14 hours under an applied potential of 20 volts.

When a feed solution is subjected to electrolysis in the manner described in the preceding paragraphs, refinement of the solution is effected by passage of contaminant anions out of the feed solution. The contaminant anions move under the influence of the electrical potential toward the anode, across the anion-permselective membrane into the anolyte. Through conventional electrochemical reactions, mineral acid of the contaminant anion is formed in the anolyte and oxygen is generated at the anode which is vented from the anolyte cell. In a similar manner, cations of the feed solution move under the influence of the electrical potential toward the cathode, across the cation-permselective membrane and into the catholyte, where strong alkali hydroxide (e.g. sodium hydroxide) is generated in the catholyte. Hydrogen is generated at the cathode, again through conventional electrochemical reactions, and is vented from the catholyte cell. Movement of the contaminant anions into the catholyte is prevented by the cation-permselective membrane, which is impermeable to anions, and similarly the cations are prevented by the anion-permselective membrane from moving into the anolyte cell.

Surprisingly, it has been found that under the conditions described above the valuable metal oxyanions contained in the feed solution are largely retained between the anion- and cation-permselective membranes, though some oxyanions do pass across the anion-permselective membrane into the anolyte. On the other hand, a sizable proportion of the contaminant anions pass into the anolyte. The exact reason for this phenomenon is not clear, and the scope of the invention is not to be limited by any particular theory that may describe the reason for this result. While there is probably some absorption of valuable metal oxyanions into the anion-permselective membrane, the major proportion of the valuable metal oxyanions stay in solution, in the feed compartment. The content of contaminant anions in what had been the feed solution decreases both in absolute terms and with respect to the valuable metal oxyanion content. The valuable metal oxyanions may be readily recovered from solution without requiring any desorption or elution from the membranes. In addition, the valuable metal oxyanions can actually be concentrated due to transport of water across the permselective membranes. This feature lessens materials handliing and reduces the energy needed to further concentrate the valuable metal oxyanions.

The strong acid which is formed in the anolyte may be recovered and used in other operations or sold, either as is or after concentration. This acid may also be used to acidify fresh feed solution which is to be treated to remove contaminant anions by the invention.

The strong hydroxide formed in the catholyte may also be drawn off and used or sold, as is or after further concentration. For instance, if the feed solution being treated is a product stream of a mineral caustic-leaching operation, the hydroxide-rich catholyte can be recycled for use as lixiviant for the leaching step.

The intermediate solution, produced by subjecting a feed solution which meets the description given previously to electrolysis under the conditions described above, may be drawn off and further processed for recovery of the valuable metal oxyanion. It is an additional feature of the invention that this intermediate solution may be treated to recover the valuable metal oxyanions as ammonium compounds, by a process which involves electrolysis of the intermediate solution between a cation-permselective membrane and anion-permselective membrane which may be similar or even identical to the permselective membranes used in the electrolysis of the feed solution. This process also permits recovery of additional quantities of strong caustic solution.

In this process, an intermediate solution which has had the contaminant anion content lowered in accordance with the process described previously is fed to another electrolytic cell, which shall be termed the "downstream" cell for clarity. The downstream cell may be, for instance, the three-compartment electrolytic cell as described previously with reference to FIG. 1. Intermediate solution is fed to feed compartment 1, which is separated by cation-permselective membrane 7 from cathode compartment 4. Cathode compartment 4 contains catholyte, which should have a pH of about 12 to about 14 and may be an aqueous solution of NaOH. The anionpermselective membrane 6 is contacted on opposing sides thereof by the intermediate solution and by an anolyte in anode compartment 2. The anolyte comprises an aqueous solution of ammonia, and has a pH of about 1.5 to about 10 and preferably about 8 to about 9. The pH of the intermediate solution is adjusted to a value which is at least about 7, and preferably between about 7 and about 10. Adjustment of pH may be made either before or while the intermediate solution is contacted with the anion-permselective and cation-permselective membranes. The pH adjustment may be made by adding suitable amounts of the alkali hydroxide generated in the catholyte during electrolysis of the feed solution, or of alkali hydroxide generated in the catholyte during the electrolysis step now being described.

Following the adjustment of the pH of the intermediate solution to at least 7, an electrical potential is applied between the anode 3 and the cathode 5 across the membranes 6 and 7. This potential may be applied in the customary manner, i.e. by connecting anode 3 while immersed in the anolyte and cathode 5 while immersed in the catholyte to a voltage source 8. Both electrodes are insoluble in their respective electrolytes. The anode 3 may be composed of tantalum, and the cathode 5 may be composed of Type 316 stainless steel. The applied voltage may be any voltage greater than about 10 volts e.g. up to about 50 volts.

Under the conditions described herein for the electrolysis of the intermediate solution, valuable metal oxyanions are able to pass across the anion-permselective membrane into the anolyte under the influence of the applied electrical potential. At the end of this electrolysis, the anolyte will typically contain the equivalent of at least about 20 gpl of valuable metal oxyanions, in the form of ammonium compounds. Oxygen is generated at the anode and is vented from the anode compartment, and ammonium compounds containing the valuable metal oxyanions are formed in the anolyte compartment. As before, there is also passage of cations from the intermediate solution into the catholyte, causing the formation of strong hydroxide in the catholyte and of hydrogen at the cathode which is vented from the cathode compartment.

The ammonium compounds formed in the anolyte may be recovered, stored, sold, or processed further in accordance with techniques known in the art to recover the valuable metal. Examples of ammonium compounds that may be recovered from the anolyte following electrolysis under these conditions are ammonium molybdate, $(NH_4)_6Mo_7O_{24}$; ammonium metatungstate, $(NH_4)_6H_2W_{12}O_{40}$; ammonium paratungstate, $(NH_4)W_7O_{24}$; and ammonium metavanadate (ammonium vanadate), $NH_4VO_3$.

Since the ammonia in the anolyte will combine in certain proportions with the valuable metal oxyanions in the intermediate solution to form the ammonium compounds, it is perferable to carry out electrolysis under conditions such that sufficient ammonia is present in the anolyte to react stoichiometrically with the valuable metal oxyanions in the intermediate solution. The stoichiometric requirements can be met at the outset, or additional ammonia (e.g. as $NH_4OH$) can be added during electrolysis.

The hydroxide formed in the catholytes during electrolysis of the intermediate solution may be recovered and recycled for use in the same manner as the catholyte formed during electrolysis of the feed solution, such as leaching operations which generated additional feed solution to be processed in accordance with this invention. The intermediate solution from which valuable metal oxyanions have been removed can be concentrated and recycled to be added to fresh feed solution or to fresh intermediate solution. By connecting feed and product streams in this manner, the invention may be practiced in a continuous manner, independently or in association with a conventional leaching operation.

If desired, one may also refine a pregnant solution by connecting several electrolytic cells together in series, so that the refined pregnant solution produced in a first electrolysis stage is electrolyzed further in a second electrolytic cell. The first electrolysis stage will have enriched the contaminant anion content of the anolyte; replacing this anolyte with anolyte having a lower contaminant anion content increases the effectiveness of continued electrolysis to further remove contaminant anions from the pregnant solution. The product from the second feed compartment, highly refined, can then be fed to the feed compartment of a third electrolytic cell, for still further refinement, or can be fed as intermediate solution to an electrolyic cell under conditions suited to permit recovery of the valuable metal oxyanions as ammonium compounds.

An alternative embodiment of the invention comprises refining a feed solution by electrolysis in accordance with the foregoing description, and then disconnecting the thus-formed intermediate solution from the electrical potential, replacing the contaminant anion-bearing anolyte with fresh anolyte comprising an aqueous solution of ammonia, adjusting the pH of the intermediate solution to at least 7, and then applying electrical potential anew to drive valuable metal oxyanions into the anolyte.

The invention may be further illustrated by the following non-limiting Examples:

EXAMPLE I

Four liters of an aqueous solution of $Na_2WO_4$ and $Na_2SO_4$ containing 88.6 gpl W and 116.8 gpl $SO_4^{-2}$ was adjusted to a pH of about 3.5 and contacted with an anion-permselective membrane (sold under product number 204VZL389 by Ionics, Inc.) comprising vinyl cross-linked with copolymers of vinyl monomers and containing quaternary ammonium anion exchange groups. The anion-permeable membrane was also contacted with 4 liters of aqueous anolyte comprising of 6.4% solution of ammonium nitrate and having a pH of about 10. At the same time, the feed solution was contacted with a cation-permselective membrane comprising sulfonated vinyl copolymers (sold under product number Nafion 310 by Ionics, Inc.) which was also in contact with 4 liters of catholyte comprising a 5% solution of sodium hydroxide. The anode was tantalum and the cathode was Type 316 stainless steel. The exposed membrane sufaces were 17.5 cm by 19.1 cm. A current density of 0.07 amps/cm$^2$ was applied for 97.6 amp-hours. The voltage was initially about 10.3 volts, but quickly dropped to about 8.5 volts. The cells had a temperature of about 43° C. Ammonia was added to the feed cell to maintain the pH in the feed cell at about 3. After 97.6 amp-hours, the feed cell was found to have about 90 gpl $SO_4^{-2}$, and 90.2 gpl W. The anolyte had about 3.85 gpl W, and about 24.2 gpl $SO_4^{-2}$. Thus, valuable metal oxyanions were substantially retained in the feed cell, while contaminant anions passed across the anion-permselecive membrane to the anolyte.

EXAMPLE II

Six liters of an aqueous solution containing 64.6 gpl W added as $Na_2WO_4$ and 233.1 gpl $SO_4^{-2}$ added as $Na_2SO_4$ and $H_2SO_4$, having a pH of about 2.5, was placed in the feed cell of a three-compartment electrolytic cell. The permselective membranes ($17.5 \times 19.1$ cm$^2$) and the electrodes were made of the same materials as those used in the cell of Example I. The anolyte was 6 liters of 2% ammonium nitrate solution, having a pH of about 8.5. Ammonia was added to the anolyte during electrolysis to maintain the anolyte pH at about 8.5. The catholyte was 6 liters of 2% sodium hydroxide. Current of 0.07 amps/cm$^2$ were applied for 87.5 amp-hours, during which time the voltage rose to about 44 volts, dropped to about 32 volts, and rose again to about 58 volts. At 87.5 amp-hours, the feed cell contained 95 gpl $SO_4^{-2}$ and 2.6 gpl $Na^+$, while the anolyte contained 6.63 gpl W and 137.7 gpl $SO_4^{-2}$.

At this point, ammonia was added to the feed cell to adjust the pH of the solution in that cell to about 7.3.

Electrolysis was continued, and it was noted that the voltage dropped to about 25 volts. The feed cell pH fell below 7 during this stage of electrolysis, but was adjusted with additional $NH_3$. The final pH was 8.0 in the feed cell. Electrolysis was discontinued 141.7 amp-hours from the point at which the feed cell pH was raised above 7. The anolyte contained 24.1 gpl W (oxyanionic) and 206.9 gpl $SO_4^{-2}$, while the $SO_4^{-2}$ concentration of the feed cell had dropped to 58.1 gpl. Thus, during electrolysis after the pH of the solution in the feed cell had been adjusted to a value greater than 7, the $SO_4^{-2}$:W ratio of the anolyte dropped from 20.8:1 to 8.6:1, indicating that valuable metal oxyanions were passing across the anion-permselective membrane.

We claim:

1. A process for refining a pregnant solution containing alkali metal cations, at least one oxyanion of a valuable metal selected from the group consisting of molybdenum, tungsten, vanadium, and uranium, and at least one contaminant anion selected from the group consisting of $PO_4^{-3}$, $SO_4^{-2}$, $NO_3^-$, $Cl^-$, $ClO_3^-$, and $ClO_4^-$, which comprises:

(a) providing a first electrolytic cell having an anode compartment equipped with an insoluble anode, a cathode compartment equipped with an insoluble cathode, and a feed compartment separating the anode compartment from the cathode compartment, said anode compartment being separated from said feed compartment by an anion-permselective membrane and said cathode compartment being separated from said feed compartment by a cation-permselective membrane;

(b) establishing an aqueous solution in the anode compartment so that the anode is immersed therein;

(c) establishing an aqueous solution in the cathode compartment so that the cathode is immersed therein;

(d) feeding to the feed compartment pregnant solution having a contaminant anion concentration of at least about 50 grams per liter and a valuable metal oxyanion content of between about 25 and 200 grams per liter;

(e) adjusting the pH of said pregnant solution in said feed compartment to a value between about 0.5 and about 4; and (f) impressing an electric potential of at least about 10 volts between the anode and cathode until the contaminant anion concentration in the pregnant solution is lowered by at least about 25 grams per liter, whereby contaminant anions from said pregnant solution migrate preferentially to the anode compartment to generate a strong acid solution, the alkali metal cations migrate to the cathode compartment to generate a strong caustic solution.

2. The process of claim 1 wherein the aqueous solution in the anode compartment has a pH between about 1.5 and about 10, and the aqueous solution in the cathode compartment has a pH between about 11 and about 14.

3. The process of claim 2 wherein said anion permselective membrane comprises an organic polyner containing quaternary ammonium anion exchange groups, and said cation-permselective membrane comprises an organic polymer containing sulfonate cation exchange groups.

4. The process of claim 3 wherein said electric potential is between about 10 volts and about 50 volts.

5. The process of claim 2 wherein said electric potential is between about 10 volts and about 50 volts.

6. The process of claim 1 or 4 wherein the pregnant solution fed to the feed compartment of said first electrolytic cell has a contaminant anion concentration of at least about 100 grams per liter.

7. The process of claim 6 wherein the electric potential is applied until the contaminant anion concentration in the pregnant solution is lowered by at least about 75 grams per liter.

8. The process of claim 1 or 4 wherein the pregnant solution fed to the feed compartment of said first electrolytic cell has a valuable metal oxyanion content between about 50 and about 150 grams per liter.

9. The process of claim 1 or 4 wherein the pH of said pregnant solution in said feed compartment is adjusted to a value between about 2.5 to about 3.5.

10. The process of claim 4 wherein the pregnant solution fed to the feed compartment of said first electrolytic cell has a contaminant anion concentration of at least about 100 grams per liter and a valuable metal oxyanion content between about 50 and about 150 grams per liter, wherein the pH of said pregnant solution in said feed compartment is adjusted to a value between about 2.5 and about 3.5, and wherein the electric potential is applied until the contaminant anion concentration of said pregnant solution is lowered by at least about 75 grams per liter.

11. The process of claim 1 further comprising the steps of (a) providing a second electrolytic cell having an anode compartment equipped with an insoluble anode, a cathode compartment equipped with an insoluble cathode, and a feed compartment separating the anode compartment from the cathode compartment, said anode compartment being separated from said feed compartment by an anion-permselective membrane and said cathode compartment being separated from said feed compartment by a cation-permselective membrane;

(b) establishing an aqueous solution in the anode compartment of said second electrolytic cell so that the anode is immersed therein;

(c) establishing an aqueous solution in the cathode compartment of said second electrolytic cell so that the cathode is immersed therein;

(d) feeding to the feed compartment of said second electrolytic cell pregnant solution which has been refined in accordance with the process of claim 1;

(e) adjusting the pH of said pregnant solution in said feed compartment to a value between about 0.5 to about 4;

(f) impressing an electric potential of at least about 20 volts between anode and cathode of said second electrolytic cell until the contaminant anion concentration in said pregnant solution is lowered to less than about 15 grams per liter, whereby contaminant anions from said pregnant solution migrate preferentially to the anode compartment to generate a strong acid solution, and alkali metal cations migrate to the cathode compartment to generate a strong caustic solution.

12. The process of claim 1 wherein the aqueous solution in the anode compartment of at least one of said first and second electrolytic cells has a pH between about 1.5 and about 10, and the aqueous solution in the cathode compartment of at least one of said first and second electrolytic cells has a pH between about 11 and about 14.

13. The process of claim 12 wherein at least one of said anion-permselective membranes comprises an organic polymer containing quaternary ammonium anion exchange groups, and at least one of said cation-permselective membranes comprises an organic polymer containing sulfonate cation exchange groups.

14. The process of claim 13 wherein the electrical potential applied to at least one of said first and second electrolytic cells is between about 10 and about 50 volts.

15. The process of claim 12 wherein the electric potential applied to at least one of said first and second electrolytic cells is between about 10 and about 50 volts.

16. The process of claim 11 or 14 wherein the pregnant solution fed to the feed compartment of said first electrolytic cell has a contaminant anion concentration of at least about 100 grams per liter.

17. The process of claim 11 or 14 wherein the pregnant solution fed to the feed compartment of said first electrolytic cell has a valuable metal oxyanion content between about 50 and about 150 grams per liter.

18. The process of claim 11 or 14 wherein the pH of the pregnant solution fed to the feed compartment of at least one of said electrolytic cells is adjusted to a value between about 2.5 and about 3.5.

19. The process of claim 14 wherein the pregnant solution fed to the feed compartment of said first electrolytic cell has a contaminant anion concentration of at least about 100 grams per liter and a valuable metal oxyanion content between about 50 and about 150 grams per liter, and wherein the pH values of the pregnant solutions fed to the feed compartments of both said first and second electrolytic cells are adjusted to between about 2.5 and about 3.5.

20. The process according to claim 1, 4, 11 or 14 for refining a pregnant solution which contains alkali metal cations, at least one oxyanion of a valuable metal selected from the group consisting of molybdenum, tungsten, vanadium, and uranium, and at least one contaminant anion selected from the group consisting of $PO_4^{-3}$, $SO_4^{-2}$, $NO_3^-$, $Cl^-$, $ClO_3^-$, and $ClO_4^-$, and recovering from the thereby refined solution an ammonium compound selected from the group consisting of ammonium molybdates, ammonium tungstates, ammonium vanadates, and ammonium uranides, comprising (a) refining the pregnant solution in accordance with the process of claim 1, 4, 11, or 14;

(b) providing a downstream electrolytic cell having an anode compartment equipped with an insoluble anode, a cathode compartment equipped with an insoluble cathode, and a feed compartment separating the anode compartment from the cathode compartment, said anode compartment being separated from said feed compartment by an anion-permselective membrane and said cathode compartment being separated from said feed compartment by a cation-permselective membrane;

(c) establishing an aqueous solution of ammonia in the anode compartment so that the anode is immersed therein;

(d) establishing an aqueous solution in the cathode compartment so that the cathode is immersed therein;

(e) feeding refined pregnant solution to the feed compartment;

(f) adjusting the pH of said refined pregnant solution in said feed compartment to at least about 7; and (g) impressing an electric potential of at least about 10 volts between the anode and cathode whereby valuable metal oxyanions migrate into the anode compartment and form the desired ammonium compound, and alkali metal cations migrate to the cathode compartment to generate a strong caustic solution.

21. The process of claim 20 wherein the aqueous solution in the anode compartment of said downstream electrolytic cell has a pH of about 1.5 to about 10, and the aqueous solution in the cathode compartment of said downstream electrolytic cell has a pH of about 12 to about 14.

22. The process of claim 21 wherein the anion-permselective membrane of said downstream electrolytic cell comprises an organic polymer containing quaternary ammonium anion exchange groups, and the cation-permselective membrane of said downstream electrolytic cell comprises an organic polymer containing sulfonate cation exchange groups.

23. The process of claim 22 wherein the electric potential applied between the anode and cathode of said downstream electrolytic cell is between about 10 volts and about 50 volts.

24. The process of claim 23 wherein the final concentration of valuable metal oxyanions in the anode compartment of said downstream electrolytic cell is at least 20 grams per liter.

25. The process of claim 20 wherein the final concentration of valuable metal oxyanions in the anode compartment of said downstream electrolytic cell is at least about 20 grams per liter.

26. The process of claim 24 wherein the pregnant solution fed to the feed compartment of said first electrolytic cell has a contaminant anion concentration of at least about 100 grams per liter.

27. The process of claim 24 wherein the pregnant solution fed to the feed compartment of said first electrolytic cell has a valuable metal oxyanion concentration between about 50 and about 150 grams per liter.

28. The process of claim 24 wherein the pH of the pregnant solution fed to the feed compartment of said first electrolytic cell is adjusted to a value between about 2.5 and about 3.5.

* * * * *